US010476240B2

(12) United States Patent
Domschat et al.

(10) Patent No.: US 10,476,240 B2
(45) Date of Patent: Nov. 12, 2019

(54) ANTISTATIC DEVICE AND ASSOCIATED OPERATING METHOD

(75) Inventors: Klaus Domschat, Loerrach (DE); Christian W. Trimborn, Lutzelhouse (FR); Armin Goepfrich, Fellbach (DE)

(73) Assignee: GEMA SWITZERLAND GMBH, St. Gallen (CH)

( * ) Notice: Subject to any disclaimer, the term of this patent is extended or adjusted under 35 U.S.C. 154(b) by 887 days.

(21) Appl. No.: 14/111,139

(22) PCT Filed: Apr. 10, 2012

(86) PCT No.: PCT/EP2012/056414
§ 371 (c)(1),
(2), (4) Date: Mar. 8, 2018

(87) PCT Pub. No.: WO2012/139996
PCT Pub. Date: Oct. 18, 2012

(65) Prior Publication Data

US 2018/0191139 A1 Jul. 5, 2018

(30) Foreign Application Priority Data

Apr. 11, 2011 (DE) ..... 10 2011 007 136

(51) Int. Cl.
*H01T 23/00* (2006.01)
*H01T 19/04* (2006.01)
(Continued)

(52) U.S. Cl.
CPC ..... *H01T 23/00* (2013.01); *B41F 13/02* (2013.01); *B65H 26/02* (2013.01); *H01T 19/04* (2013.01); *B65H 2515/716* (2013.01)

(58) Field of Classification Search
CPC ..... H01T 23/00; H01T 19/04; B65H 26/02; B65H 2515/716; B41F 13/02
(Continued)

(56) References Cited

U.S. PATENT DOCUMENTS 4,901,194 A 2/1990 Steinman et al.
6,088,211 A 7/2000 Pitel et al.
(Continued)

FOREIGN PATENT DOCUMENTS

DE 19711342 A1 9/1998
DE 202005012290 U1 10/2005
(Continued)

OTHER PUBLICATIONS

English abstract for DE-102009033827.
English abstract for DE-202005012290.

*Primary Examiner* — Zeev V Kitov
(74) *Attorney, Agent, or Firm* — Kinney & Lange, P.A.

(57) ABSTRACT

An antistatic device for reducing electrostatic charges on moving material webs may include an active positive electrode assembly having a plurality of active individual positive electrodes electrically connected to a positive high voltage source. The device may include an active negative electrode assembly having a plurality of active negative electrodes electrically connected to a negative high voltage source. A sensor system may be included for detecting a polarity of a neutralizing current between the material web and the antistatic device during operation of the antistatic device, and a controller for controlling the high voltage sources. The controller may be coupled to the sensor system and may be at least one of programmed and configured to one of active or leave activated the high voltage source required in each case and one of deactivate and leave deactivated the high voltage source not required in each case in response to the detected polarity of the neutralizing current.

15 Claims, 4 Drawing Sheets

(51) Int. Cl.
*B65H 26/02* (2006.01)
*B41F 13/02* (2006.01)

(58) Field of Classification Search
USPC ..... 361/212
See application file for complete search history.

(56) References Cited

U.S. PATENT DOCUMENTS

| | | | | |
|---|---|---|---|---|
| 6,259,591 | B1 | 7/2001 | Pitel et al. | |
| 6,504,700 | B1 | 1/2003 | Hahne et al. | |
| 6,674,630 | B1 * | 1/2004 | Gefter | H05F 3/04 361/212 |
| 7,679,026 | B1 | 3/2010 | Gefter et al. | |
| 2003/0043529 | A1 | 3/2003 | Jacobs et al. | |
| 2003/0183195 | A1 * | 10/2003 | Uchida | F02D 35/027 123/406.33 |
| 2007/0274019 | A1 * | 11/2007 | Nakajima | H01T 23/00 361/231 |
| 2009/0168288 | A1 * | 7/2009 | Hashimoto | H01T 23/00 361/213 |

FOREIGN PATENT DOCUMENTS

| | | | |
|---|---|---|---|
| DE | 69830609 | T2 | 5/2006 |
| DE | 102009033827 | B3 | 3/2011 |
| EP | 2061125 | A2 | 5/2009 |

* cited by examiner

ANTISTATIC DEVICE AND ASSOCIATED OPERATING METHOD

CROSS REFERENCE TO RELATED APPLICATIONS

This application claims priority to German Patent Application No. 10 2011 007 136.9 filed Apr. 11, 2011, and International Patent Application No. PCT/EP2012/056414 filed Apr. 10, 2012, both of which are hereby incorporated by reference in their entirety.

TECHNICAL FIELD

The present invention relates to an antistatic device for reducing electrostatic charges on moving material webs. The invention also relates to a method for operating such an antistatic device.

BACKGROUND

Electrostatic charges are created when dielectric materials are moved relative to each other or to other materials. Electrostatic charges are critical particularly in applications involving fast moving, thin sheets of material, such as paper or foils. If these electrostatic charges are not reduced or neutralised, they can lead to uncontrolled discharges. Discharges of such kind can injure people, damage materials and cause sparks, fire and explosions. In addition, downstream processes such as coating, printing and finishing are impaired. This can also affect product quality significantly, even to the point of complete destruction of the product or material.

An active electrode assembly comprising a plurality of active needle-shaped individual electrodes that are electrically connected to a high voltage source and supplied with alternating current when an antistatic device is in operation is known from DE 1 197 1 342 A1. In this case, the electrode assembly is arranged in a bar-shaped electrode carrier in which a ground conductor is also integrated.

From U.S. Pat. No. 6,674,630 B1, antistatic devices are known in which either two active electrode assemblies with the same polarity are arranged consecutively in the direction of movement of a material web, or in which two pairs of electrode assemblies are arranged consecutively in the direction of movement of a material web, each pair comprising a positive electrode assembly and a negative electrode assembly that are arranged consecutively in the direction of movement of the material web. In these known antistatic devices, the neutralisation current flowing at the active electrode assemblies is measured and evaluated. The neutralisation efficiency and the residual charge remaining on the material web is calculated on the basis of the detected current. The speed of advance of the material web can then be adjusted depending on this residual charge.

A further antistatic device in which an active positive electrode assembly and an active negative electrode assembly are arranged consecutively in the direction of movement of the material web and wherein the neutralisation efficiency can be measured with the aid of the measured neutralisation currents of the active electrode assemblies is known from U.S. Pat. No. 6,259,591.

Such systems, in which both positive and negative electrodes are active during operation, can also be described as bipolar systems.

Active electrode assemblies differ from passive electrode assemblies in that the active electrode assemblies are connected to a high voltage source, whereas passive electrode assemblies are connected to a grounding element, particularly an earthing conductor. For the purposes of the present, high voltage is considered to be at least 1 kV.

For an active electrode assembly of such kind, it is generally possible to actuate the associated high voltage sources in order to generate an alternating current or a pulsed DC current, and in the case of pulsed DC current it is advantageous to actuate both high-voltage sources of a positive electrode assembly and a negative electrode assembly deliberately so that positive voltage pulses at the positive electrode assembly alternate with negative voltage pulses at the negative electrode assembly, thereby creating a virtual AC so to speak, if the two electrodes are considered as a single unit. However, the "zebra effect" is observed with alternating current and pulsed direct current. An unnecessary half-wave and half-polarity exist between each of two positive or negative voltage pulses, and neutralisation does not take place here because this half-wave has exactly the same polarity as the web and is therefore not available for discharging the material web and thereby avoiding personal injury, material damage, sparks, fire and explosions. Moreover, the voltage requires a certain time at the beginning of each voltage pulse until the ionisation voltage is built up. The ionisation voltage is the voltage level at which the ionisation of the surrounding air molecules begins at a charged peak. This ionisation phase based on a certain minimum voltage is absolutely necessary in order for the neutralisation to take place. The neutralising effect of the respective electrode assembly is reduced or even cancelled out entirely during these temporally delayed build-up and decay phases of the respective voltage pulse and during the unnecessary half-waves and polarities. Then, neutralised and non-neutralised or incompletely neutralised sections of the web may occur consecutively like zebra stripes depending on the speed of movement of the material web. The distances between these stripes, that is to say the bars of the zebra stripes, are correlated to the pulse frequency of the ionisation and the speed of the web.

SUMMARY

The present invention addresses the problem of providing an improved embodiment of an antistatic device of the type described in the introduction, and an associated operating method, which is characterized in particular by the absence of web sections that are not neutralised or not completely neutralised, and at the same time consumes less energy.

This problem is solved with the present invention in particular by the subject matter of the independent claim. Advantageous embodiments are the subject matter of the dependent claims.

The invention is based on the general idea for an antistatic device comprising at least one positive electrode assembly and at least one negative electrode assembly of deactivating the electrode assembly that is not required depending on the polarity of the material web that is to be neutralised and only keeping the single electrode assembly that is required active in unipolar mode.

The antistatic device according to the invention preferably comprises only one positive electrode assembly and only one negative electrode assembly. It is further preferred that the respective active electrode array comprises only one row of needle-shaped electrodes arranged side by side and transversely to the direction of movement of the material web, so that a maximum of two rows of needles or two rows of electrodes are provided to make up both active electrode assemblies. According to a particularly advantageous embodiment, the needle-shaped electrodes of the positive electrode assembly and the negative electrode assembly may be arranged side by side in the same row transversely to the direction of movement of the material web, so that in extreme cases both active electrode assemblies may be constituted by a single row of electrodes or needles.

In particular, in the context of the invention the controller can activate or leave activated the negative high voltage source and deactivate or leave deactivated the positive high voltage source for a positive neutralisation current, and activate or leave activated the positive high voltage source for a negative neutralisation current. In this context, the invention makes use of the discovery that the polarity set up on a material web during a production process remains constant as long as the process parameters do not change. However, this polarity cannot be predicted. Based on the check of the polarity set up on the material web as suggested according to the invention, the active electrode assembly that is not required can be deactivated in each case, since it is essentially unable to contribute to the neutralisation of the electrostatic charge on the material web. Compared with other systems, this system then continues working in unipolar, not bipolar mode. The deactivation of the unused electrode enables the energy consumed by the antistatic device to be reduced significantly, since it is not necessary to apply a high voltage to the electrode assembly that is not needed. The antistatic device according to the invention operates in unipolar DC mode with the unnecessary electrode assembly deactivated, which significantly reduces the energy consumption of the antistatic device. The inventive unipolar DC mode of the antistatic device is preferably non-pulsed so that the required neutralisation current is constant and constantly present, which significantly reduces the control and regulation effort.

In an advantageous embodiment, it may be provided that the controller is configured and/or programmed such that it is switchable between at least a learning phase and a working phase. In the learning phase, both the positive high voltage source and the negative high voltage source are activated, while in the working phase only one of the high voltage sources, the high voltage source required for neutralising the material web, is activated. The sensor system may now advantageously be configured and/or programmed in such manner that during the learning phase it monitors the currents leaving each high voltage source, that is to say the neutralisation currents from the active electrode assemblies, to detect the polarity of the neutralisation current of ach high-voltage source. Inevitably, the current flow is markedly greater at one of the high voltage sources than at the other, from which it is possible to deduce the polarity of the charge of the material web and the polarity of the neutralisation current.

Alternatively, in another embodiment it may be provided that a passive sensor electrode assembly comprising a plurality of needle-shaped individual sensor electrodes is provided in addition to the two electrode assemblies, and is electrically connected to a grounding element when the antistatic device is operating. By virtue of it connection to the grounding element, the sensor electrode assembly becomes a passive electrode assembly. Moreover, the sensor assembly may now be programmed and/or configured in such manner that it monitors the current flowing away from the sensor electrode assembly, that is to say the neutralisation current of the sensor electrode assembly, to detect the polarity of the neutralisation current.

In this case, the invention is thus based on the general idea of providing at least one sensor electrode assembly in an antistatic device comprising at least one positive electrode assembly and at least one negative electrode assembly, which may be used to help detect the polarity of a neutralisation current of the sensor electrode assembly, so that the respective unnecessary electrode assembly may be deactivated according to the polarity determined, and only the electrode assembly that is needed may be actively operated. In particular, to this end the controller may activate or leave active the negative high voltage source and deactivate or leave deactivated the positive high voltage source in the case of a positive neutralisation current, and deactivate or leave deactivated the negative high voltage source and activate or leave activated the positive high voltage source in the case of a negative neutralisation current. In this context, the invention makes use of the discovery that the polarity set up on a material web during a production process remains constant as long as the process parameters do not change. However, this polarity cannot be predicted. Based on the check of the polarity set up on the material web as suggested according to the invention, the active electrode assembly that is not required can be deactivated in each case, since it is essentially unable to contribute to the neutralisation of the electrostatic charge on the material web. The deactivation of the unused electrode enables the energy consumed by the antistatic device to be reduced significantly, since it is not necessary to apply a high voltage to the electrode assembly that is not needed.

With the antistatic device according to the invention it is advantageous for the sensor electrode assembly to be connected to a grounding element, particularly an earth conductor, particularly via a measuring resistor. In this way, the sensor electrode assembly also functions as a passive neutralisation electrode assembly that is directly capable of neutralising a large part of the electrostatic charge in the material web. As a consequence of this passive neutralisation at the sensor electrode assembly, a neutralisation current is generated at the sensor electrode assembly that may be measured using a corresponding measuring resistor, for example. At the same time, the effect of the sensor electrode assembly as a passive neutralising electrode assembly also makes it possible to reduce the power at the respective active electrode assembly or to achieve a better neutralising effect with the same power, or to set a greater distance between the electrode assembly and the material web.

In particular, with the sensor system it is possible to measure the level of the neutralisation current in order to adjust or fine tune the power at the respectively required ionisation electrode assembly depending on the measured current level.

According to another advantageous embodiment, provision may be made to actuate the currently activated high voltage source in such manner that it delivers a non-pulsed, preferably constant positive or negative DC voltage. By using a non-pulsed direct current it is possible to draw the charge off from the material web continuously and thus to neutralise the charge thereon. By using non-pulsed DC voltage, it is possible to prevent the zebra effect to a large extent, and particularly completely, so that a particularly high-quality, constant and continuous neutralisation of the material web can be achieved to a large degree and particularly entirely without a residual charge.

According to another advantageous embodiment, provision may be made to actuate the high voltage sources for generating a pulsed DC voltage at the respective active electrode assembly during a learning phase, so that a pulsed DC voltage is present at both the positive electrode assembly and the negative electrode. Here too, it may be advantageously provided to actuate the high voltage sources in such manner that the pulsed DC voltages are present at the positive electrode assembly and the negative electrode assembly alternately. In other words, a positive voltage pulse at the positive electrode assembly occurs simultaneously with a voltage gap at the negative-electrode assembly, and a voltage gap at the positive electrode assembly coincides with a negative voltage pulse at the negative electrode assembly.

The polarity of the neutralisation current of the sensor electrode assembly is determined during this learning phase. As soon as it is established that a given polarity is present and steady, the switch is made to a working phase, during which the electrode assembly and the high voltage source therefor are switched off, while the electrode assembly that is still needed remains active, and the high voltage source associated therewith is actuated to generate a non-pulsed DC voltage. This embodiment assumes that during the learning phase, which can be initiated for example by a change in the process parameters of a production process connected to the material web, such as changing the web, it is initially unclear which polarity will be set up on the web. During this learning phase, both active electrode assemblies, that is to say both the positive electrode assembly and the negative electrode assembly, are then activated in order to ensure effective neutralisation even during the learning phase. During said learning phase, both active electrode assemblies are supplied with pulsed DC voltage. However, as soon as the polarity becomes stable and is identified during the learning phase, the system switches to the working phase, in which only one of the active electrode assemblies is activated, and this assembly is supplied with non-pulsed DC voltage. Here too, the non-pulsed DC voltage is preferably constant.

It is also possible for both high voltage sources to be deactivated during the learning phase, and in the working phase only the high voltage source for the required electrode assembly is activated. This is particularly advantageous when the controller is able to activate the required electrode assembly rapidly on the basis of the detected polarity of the material web.

In another embodiment, a neutralisation current of the respective activated active electrode assembly may be measured with the sensor system, using a current measuring device, for example. With this arrangement, the neutralisation current of the respective activated active electrode assembly will also be monitored during the working phase. Then it becomes possible to switch between two operating modes of the antistatic device depending on the measured neutralisation current of the active electrode assembly. For example, a distinction can be made between a primary operating mode or primary operation and a fallback operating mode or fallback operation. In primary operation, only one of the two high voltage sources is active, in particular to supply the associated electrode assembly with non-pulsed direct current. This primary operation thus corresponds in particular to the desired operating state for the working phase. On the other hand, the particular characteristic of the fallback mode may be that both high voltage sources are active, and preferably in such manner that both electrode assemblies are supplied with pulsed DC voltage, particularly in an alternating sequence. The fallback operating mode may thus correspond in particular to the learning phase with active ionisation electrodes. In general therefore, such an embodiment may also be created in such manner that a switch can be made from the learning phase to the working phase depending on the neutralisation current of the sensor electrode assembly, yet it is still possible for the system to be switched back to the learning phase depending on the neutralisation current of the electrode assembly that is activated during the working phase. For example, if the neutralisation current at the active electrode assembly becomes too weak, this may be an indication that a process parameter has been changed, so the polarity on the material web has also changed. Accordingly, a new learning phase may then be initiated by the monitoring system for the neutralisation current of the active electrode assembly, for example.

In another advantageous embodiment it may be provided that for example an eroded and/or contaminated electrode may be detected by monitoring the quiescent current of at least one of the active electrode assemblies and/or of the sensor electrode assembly. Thus, a diagnosis of the antistatic device can be performed by monitoring the quiescent current. A quiescent current of such kind occurs particularly when the material web has practically no electrostatic charge and/or when the web is idling or only moving very slowly. In this case, for example, the positive ions of the positive-electrode assembly can migrate through the air to the negative electrode assembly and create a current flow, the quiescent current described in the preceding. In the same way, ions from the positive electrode assembly and ions from the negative electrode assembly can also migrate through the air to the sensor electrode assembly, which is electrically connected to the ground, so a quiescent current can arise in this direction too. Such a quiescent current can also be measured advantageously during a diagnostic phase of the antistatic device, which is characterised by a low electrostatic charge of the material web. For example, the electrostatic charge initially builds up gradually on the material web when the web begins moving, so it is particularly useful to make provision for such a diagnostic phase when the material web is beginning to move or at a standstill.

For example, a drop in the quiescent current, for example below 50% or 40% of a reference current may be indicative of electrically non-conductive contamination of the electrodes concerned. In this context, the reference current in question represents the 100% value. Alternatively, for example, an increase in the quiescent current to more than 150% or more than 160% of a reference current for example, may be indicative of electrically conductive contamination of the electrodes concerned. In this context, the reference current in question represents the 100% value. Therefore, if electrode contamination is detected by analysing the quiescent current of the active electrode assemblies and/or of the sensor electrode assembly, a corresponding contamination alert can be generated on a corresponding monitoring means. Optionally, it may also be indicated whether the contamination is electrically conductive or electrically non-conductive, so that appropriate countermeasures can be taken.

It is further possible that, starting from a base reference current that is present with new electrodes, a new reference current is established each time after the electrodes are cleaned. Inevitably, the new reference current will be lower than the base reference current. The constantly revised reference current decreases steadily over time. The decrease in the reference current correlates with the erosion of the electrodes. A monitoring device can then detect a cleaning process of the electrodes automatically, since cleaning the electrodes causes the quiescent current to change abruptly in the direction of the respective preceding reference current.

When a predetermined degree of electrode erosion is reached relative to the base reference current, an appropriate maintenance signal can be generated again.

Accordingly, the quiescent current and the diagnostic phase is preferably present when the material web is not charged and/or when it is at a standstill. In contrast, the learning phase and a neutralisation current of the sensor electrode assembly is present in particular when the material web speeds up and already carries a certain charge that can be passively drawn off. In the working phase, the material web moves at the normal working speed and carries the charge that it collects, so that a neutralisation current flows at each active ionisation electrode assembly.

Since the antistatic device according to the invention only works with one active electrode assembly when it is operating, that is to say during the working phase, no particularly great distance must be maintained between the electrode assemblies in the direction of movement of the material web. For example, the two active electrode assemblies may be at a distance from one another in the direction of movement of the material web that is smaller than the length of the antistatic device transversely to the material web, or smaller than a distance between a first and a last electrode of an electrode group comprising 10 or 5 electrodes arranged one after the other or side by side within one of the electrode assemblies. To this extent, the antistatic device according to the invention has a relatively compact construction.

According to a particularly advantageous embodiment, the two active electrode assemblies may be arranged in or on a common bar-shaped electrode carrier, which make installation of the antistatic device considerably easier. If the above-mentioned sensor electrode assembly is also present, it can also be arranged in or on said common electrode carrier to good effect. Such an electrode carrier may be suitably equipped with connections for the high voltage sources and the sensor system to enable the positive electrode assembly to be connected electrically to the positive high voltage source, the negative electrode assembly to the negative high voltage source and optionally the sensor electrode assembly to the sensor system.

The electrode carrier may comprise a partition wall extending between the active electrode assemblies on the one side and the sensor electrode assembly on the other. The partition wall may particularly be electrically insulating. The partition wall may thus reduce the risk of a short circuit between the active electrodes and the sensor electrodes via the direct air route, since it forces an alignment of the ion movement toward the material web. This alignment of the ion movement toward the material web may be improved for example if the partition wall protrudes beyond the electrodes or the electrode tips thereof in the direction of the material web.

In another embodiment, the electrode carrier may comprise at least one high voltage conductor, which is electrically connected to the respective high voltage connection. The present of the high voltage conductor makes it particularly easy to connect the individual electrodes of each electrode assembly to the respective high voltage source. According to a particularly advantageous embodiment, the respective high voltage conductor may be made from a carbon fibre composite element, which may serve at the same time to stiffen the electrode carrier. In particular, the high voltage conductor and the carbon fibre composite element is flat or in the form of a strip, and particularly configured with a rectangular profile.

The sensor electrodes are advantageously arranged side by side in a straight row of sensor electrodes. The positive electrodes may also be arranged side by side in a straight row of positive electrodes. Additionally, the negative electrodes may also be arranged side by side in a straight row of negative electrodes. According to a particularly useful embodiment, the positive and negative electrodes may be arranged in alternating sequence side by side in a common straight row of electrodes. This results in a particularly compact construction of the antistatic device and the electrode carrier.

In particular, the antistatic device may then comprise two rows of electrodes, which are arranged one behind the other relative to the direction of movement of the material web, wherein one row of electrodes contains the sensor electrodes while the other contains the positive and negative electrodes. In another embodiment it may be provided that the sensor electrodes, the positive and negative electrodes are arranged in alternating sequence side by side in a common straight row of electrodes. Thus, only one row of electrodes is discernible, and it contains positive electrodes, negative electrodes and sensor electrodes in an appropriately alternating sequence. In this way, the construction of the antistatic device and the electrode carrier is particularly compact.

For practical purposes, the sensor electrode assembly is arranged before the active electrode assemblies in the direction of movement of the material web when the antistatic device is in operation. In this way, the sensor electrode assembly is able to measure the polarity of the material web before the web reaches the active electrode assemblies. Surprisingly, however, it has been found that positioning the sensor electrode assembly before or after the active electrode assemblies is of little importance for the antistatic device according to the invention, which means that an embodiment is also possible in which the sensor electrode assembly is positioned after the active electrode assemblies in the direction of movement of the material web.

According to an advantageous embodiment, it may be provided that each positive electrode is disposed on a separate carrier foil on which an associated series resistor of the positive electrode is imprinted. It may further be provided that a plurality of positive electrodes is disposed on a shared carrier foil, on which a corresponding number of series resistors for the positive electrodes is imprinted. It is further possible to arrange all of the positive electrodes on a shared carrier foil, on which all of the series resistors associated with the positive electrodes are imprinted. The same also applies for the negative electrodes and the sensor electrodes. Thus, a separate carrier foil with corresponding series resistor may be provided for each negative electrode. Likewise, a plurality of carrier foils may be provided, on which a plurality of negative electrodes is disposed and which include a plurality of series resistors for the negative electrodes. A shared carrier foil may also be provided for all negative electrodes, which foil is furnished with all of the series resistors for the negative electrode. A carrier foil for each sensor electrode, each of which is imprinted with a series resistor for the respective sensor electrode is also conceivable. Likewise, a plurality of carrier foils may be provided on which a plurality of sensor electrodes are arranged and on which a plurality of series resistors are imprinted for the sensor electrodes. Finally, an embodiment is conceivable in this respect too, in which a single carrier foil is provided, on which all sensor electrodes are disposed and which bears all of the series resistors for the sensor electrodes in the form of imprinted resistors.

Furthermore, it is also possible to arrange the positive and negative electrodes on a shared carrier foil on which the series resistors of the positive and negative electrodes are imprinted. An embodiment is also conceivable in which the sensor electrodes and the positive and/or negative electrodes are all arranged on a common carrier foil on which the series resistors of the sensor electrodes and the series resistors of the positive and/or negative electrodes are imprinted. The use of such carrier foils with imprinted resistors results in a particularly inexpensive construction of the respective electrode arrangement, and ultimately of the antistatic device. Furthermore, when such carrier foils are used the electrode support can be constructed with a particularly flat design.

Optionally, it may also be provided that the carrier foil with the electrodes and the series resistors is provided as a continuous strip, which greatly simplifies component collection for the electrode assemblies and renders their manufacture relatively inexpensive. In addition or alternatively thereto, it may be provided that the carrier foil is imprinted with series resistors on both sides. This enables an extremely compact design, in that for example both positive and negative electrodes can be attached to different sides of the carrier foil together with their associated series resistors. Additionally or alternatively thereto, it may be provided that the carrier foil is made of a flexible material, which facilitates handling of the carrier foil.

The present invention is also represented by an operating method in which an antistatic device comprising an active positive electrode assembly and an active negative electrode assembly is operated in such manner that the polarity of the material web is determined initially, and thereafter only the ionisation electrode assembly required is activated or left in the active state, whereas the ionisation electrode assembly that is not needed in each case is deactivated or left in the deactivated state.

In this context, a particularly advantageous embodiment is one in which the polarity of the material web is determined during a learning phase, and in a subsequent working phase the required active ionisation of the electrode assembly is carried out with a non-pulsed DC voltage.

During the learning phase, both ionisation electrode assemblies can be operated in alternating sequence with pulsed DC voltage in order to be able to deionise or neutralise the web to a certain degree during the learning phase. However, in principle it is also possible to leave both ionisation electrode assemblies deactivated during the learning phase, so that only the required ionisation electrode assembly is activated for the working phase.

During the working phase, a neutralisation current of the active ionisation electrode assembly may be monitored, and can then be switched to another mode automatically, particularly to the learning phase, depending on the calculated neutralisation current.

In another embodiment, it is also possible to measure a quiescent current of at least one of the two ionising electrode assemblies and/or the sensor electrode assembly, particularly during a diagnosis phase. The current state of the antistatic device can be evaluated depending on the measured quiescent current. For example, electrode consumption and/or electrode contamination can be detected on the basis of the measured quiescent current.

A particularly advantageous embodiment of the operating method is one in which the two active electrode assemblies are operated with a pulsed DC voltage during a learning phase in such manner that positive current pulses of the positive electrode arrangement are alternated with negative current pulses of the negative electrode assembly, and in which the active electrode assembly that is not needed is deactivated during a working phase, while only the required active electrode assembly is activated and is operated with non-pulsed DC voltage. To this extent, therefore, a bipolar pulsed DC mode (DC operation) is set in order to determine the polarity of the material web, and a unipolar non-pulsed DC mode is set for the actual neutralising operation. Since the learning phase is typically tiny compared with the working phase, the antistatic device presented here functions with significantly lower power consumption than conventional bipolar DC systems.

In this context, it may be practically provided that during the learning phase the two active electrode assemblies are initially operated with a predetermined initial pulse width ratio of positive to negative current pulses. In this case, a particularly advantageous embodiment is one in which, after the polarity of the material web has been determined during the learning phase, both active electrode assemblies are operated with at least one transition pulse width ratio of positive current pulses to negative current pulses, wherein for this at least one transition pulse width ratio the current pulses required to neutralise the material web are made longer than the initial pulse width ratio, and the current pulses that are not needed are made correspondingly shorter. This procedure may be used to verify the previously determined polarity again during the learning phase, before the high voltage source that is not needed is deactivated. This provides a greater degree of operational reliability. For example, the output pulse width ratio may be 50:50, so that the positive current pulses are the same length as the negative current pulses. If the material web has a negative polarity, then initially a transition pulse width ratio of 75:25 can be set, for example, in which the positive current pulses are therefore made longer in time, while the negative current pulses are made shorter. In the working phase, the high voltage source that is not needed, for example the negative high voltage source, is then deactivated, the system also switched from pulsed mode to non-pulsed mode, which in the example given finally results in a working pulse width ratio of 100:0.

Other important features and advantages of the invention will be apparent from the dependent claims, the drawings and the associated description of the drawings with reference to the figures.

Of course, the above-mentioned features and the features that will be explained in the following can be used not only in the combination presented for each, but also in other combinations or alone without departing from the scope of the present invention.

Preferred embodiments of the invention are illustrated in the drawings and will be explained in greater detail in the following description, wherein like reference signs refer to identical or similar or functionally equivalent components.

DETAILED DESCRIPTION

Figure 1:
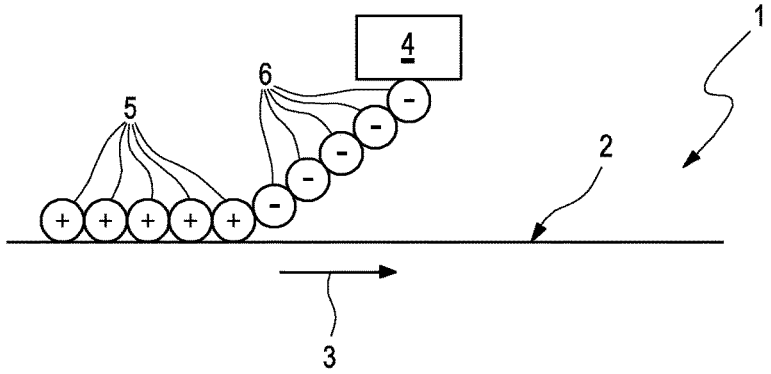
FIG. 1 a highly simplified view of a production facility in the area of an antistatic device, FIG. 2 a block diagram of the antistatic device, FIG. 3 a voltage-time diagram illustrating different phases of operation of the antistatic device, FIGS. 4-6 each show a highly simplified isometric view of various embodiments of an electrode carrier, FIG. 7 a cross section through an electrode carrier, FIGS. 8 and 9 each show a plan view of various embodiments of a substrate.

As shown in FIG. 1, a production facility 1 in which a material web 2 is moved in a direction of movement 3 comprises at least one antistatic device 4 with the aid of which an electrostatic charge on material web 2 may be reduced and preferably eliminated. Purely for exemplary purposes, in FIG. 1 five positive charge units 5 are indicated on material web 2 before antistatic device 4 in direction of movement 3, wherein said charge units are carried by material web 2 as a result of the production process. Five negative charge units 6 that are generated with the aid of antistatic device 4 are indicated in the area of antistatic device 4 and effect a neutralisation of the positive charge of five positive charge units 5. In the ideal case illustrated, material web 3 has no charge or is charge-neutral after antistatic device 4 in direction of movement 3 of the web.

Figure 2:
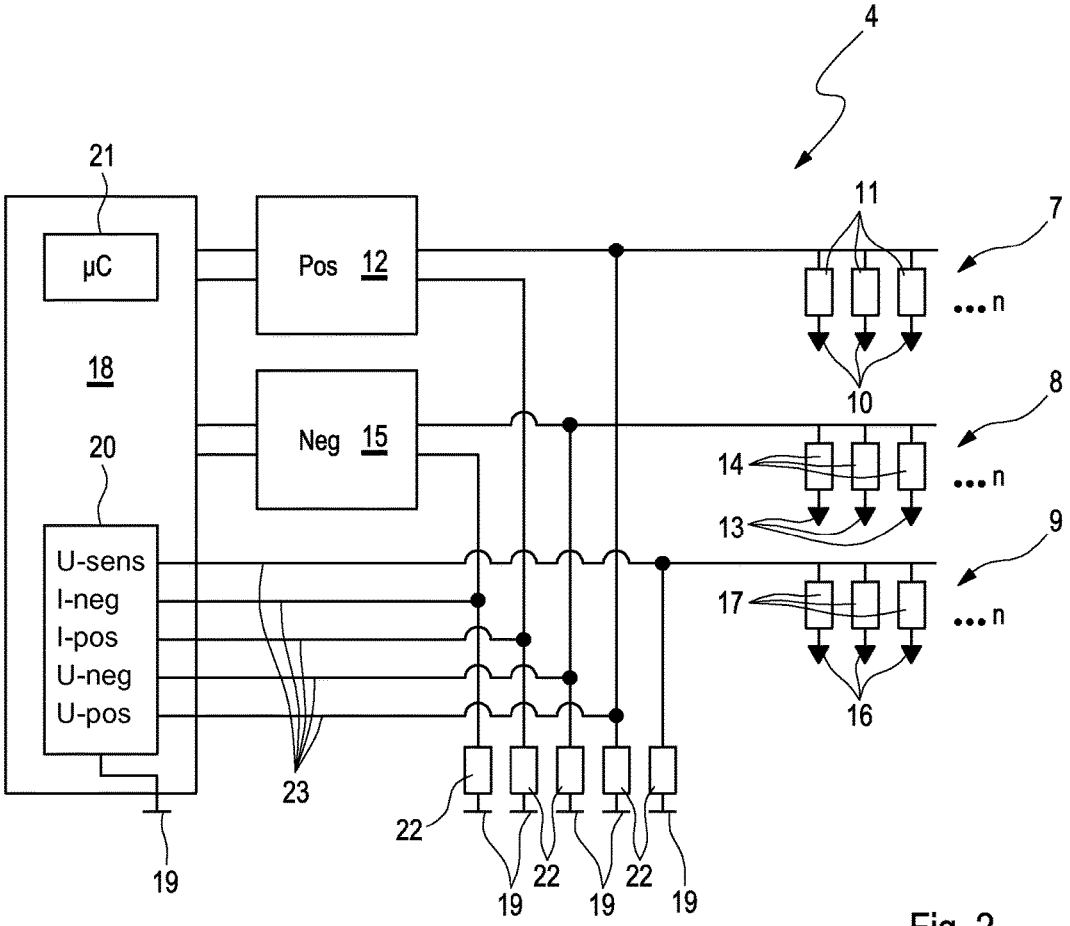

As shown in FIG. 2, antistatic device 4 comprises an active positive electrode assembly 7, an active negative electrode assembly 8, and in the example shown a sensor electrode assembly 9 as well. Positive electrode assembly 7 comprises a plurality of active needle-shaped individual positive electrodes 10, to each of which, in FIG. 2, a single series resistor 11 is assigned and which are connected electrically to a positive high voltage source 12. Negative electrode assembly 8 comprises a plurality of active needle-shaped individual active negative electrodes 13, to each of which, according to FIG. 2, a single series resistor 14 is assigned and which are connected electrically to a negative high voltage source 15. Sensor electrode assembly 9 comprises a plurality of individual needle-shaped sensor electrodes 16, to each which, as shown in FIG. 2, a single series resistor 17 is assigned, and which are connected electrically to a grounding element 19. Grounding element 19 is usually an earth conductor. Positive electrode assembly 7 and negative electrode assembly 8 may also be referred to as ionisation electrode assemblies 7, 8. Generally, in another embodiment said sensor electrode assembly 9 may also be dispensed with.

A controller 18 cooperates with a sensor system 20, which may be used to determine a polarity of a neutralisation current of sensor electrode assembly 9 during the operation of antistatic device 4. Controller 18 serves to actuate high voltage sources 12, 15 and is suitably coupled to sensor system 20. In the example, sensor system 20 is integrated with controller 18. In order to evaluate the signals detected with the aid of sensor system 20 and actuate high voltage sources 12, 15, controller 18 may contain a corresponding microprocessor 21.

FIG. 2 also shows a plurality of measuring resistors 22, via which electrode assemblies 7, 8, 9 and high voltage sources 12, 15 are connected to grounding element 19, wherein parallel sensor lines 23 are routed to controller 18 and to sensor system 20, which is able to detect the currents flowing through its grounding element 19.

In this way, the polarity of the charge of material web 3 may be detected through sensor system 20 in conjunction with sensor electrode assembly 9 from the polarity of the neutralisation current of sensor electrode assembly 9. Since sensor electrodes 16 are connected to grounding element 19 via their series resistors 17 and measuring resistor 22, sensor electrode assembly 9 functions as a passive neutralising electrode assembly, through which a neutralisation current flows when material web 2 carries a corresponding charge. The polarity of the charge on material web 2 may be detected by determining the polarity of the neutralisation current. If sensor electrode assembly 9 is not present, the polarity of material web 2 may also be determined with reference to the neutralisation currents that drain off from active electrode assemblies 7, 8, and are detectable by sensor system 18. For example, if a relatively large neutralisation current is flowing at positive electrode assembly 7, it may be assumed that material web 2 is negatively polarised. In this case, both active electrode assemblies 7, 8 are activated while the polarisation of material web 2 is being determined.

Controller 18 can now disable the active electrode assembly 7, 8 that is not needed depending on the polarity determined. For example, the polarity of the neutralisation current of sensor electrode assembly 9 may be negative, which indicates a negative charge of material web 2. Subsequently, controller 18 activates positive high voltage source 12 and therewith positive electrode assembly 7. At the same time, negative high voltage source 15 and therewith negative electrode assembly 8 is deactivated. On the other hand, if it is determined that the neutralising current of sensor electrode assembly 9 is positive, this indicates that the charge carried by material web 2 is positive. Accordingly, controller 18 causes positive high voltage source 12 to be deactivated, and therewith deactivates positive electrode assembly 7, while simultaneously activating negative high voltage source 15 and negative electrode assembly 8.

Controller 18 preferably actuates the currently activated high voltage source 12 or 15 at least during a working phase in such manner that a non-pulsed DC voltage is present at the respective active electrode assembly 7, 8, and this voltage is preferably also constant.

Figure 3:
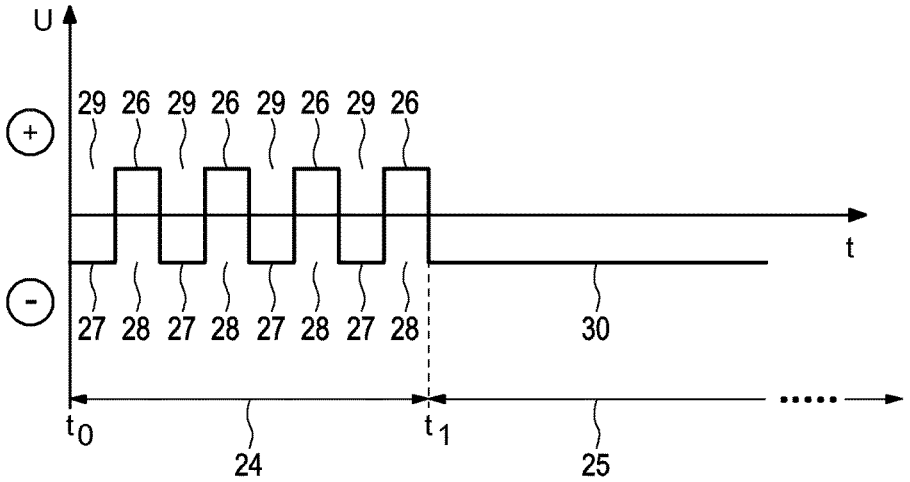

A particularly advantageous approach, which can be implemented with the aid of controller 18, is explained in detail with reference to FIG. 3. For this purpose, controller 18 is configured and programmed accordingly. In the diagram in FIG. 3, the X axis defines a time axis t, and the Y axis indicates voltage U at active electrode assemblies 7, 8. In this context, the voltage curve of positive electrode assembly 7 is located in the positive area of the Y axis, and the voltage curve of negative electrode assembly 8 is reflected in the negative area of the Y axis. Time axis t is divided into a learning phase 24 and a working phase 25. During learning phase 24, which begins at a time $t_0$, controller 18 causes for example positive high voltage source 12 to supply positive electrode system 7 with positive voltage pulses 26. At the same time, negative electrode assembly 8 is supplied with negative voltage pulses 27 by negative high voltage source 15. Advantageously, positive voltage pulses 26 and negative voltage pulses 27 are temporally phase-offset relative to each other to such a degree that a kind of rectangular AC voltage is created over both active electrode assemblies 7, 8. In other words, positive voltage pulses 26 are positioned synchronously with gaps 28 between adjacent negative voltage pulses 27. Conversely, negative voltage pulses 27 are also positioned so that they take place synchronously with gaps 29 between adjacent positive voltage pulses 26. During learning phase 24, controller 18 in conjunction with sensor system 20 determines the polarity of the neutralisation current of sensor electrode assembly 9. In the example of FIG. 3, a positive polarity is determined, so that the system switches from learning phase 24 to working phase 25 at a $t_1$. If the polarity of the neutralisation current of sensor electrode assembly 9 is positive, positive high voltage source 12 is deactivated in working phase 25, so that a voltage is no longer supplied to positive electrode assembly 7. At the same time, negative high voltage source 15 is actuated in such manner that starting from said time $t_1$ it generates a non-pulsed negative DC voltage 30.

In another embodiment, it may be provided that both ionisation electrode assemblies 7, 8 are deactivated during learning phase 24. As soon as a neutralising current with stable polarity is detected via sensor electrode assembly 9, controller 18 causes the respective required ionisation electrode assembly 7, 8 to be activated.

During this working phase 25, the neutralisation current of the respective active electrode assembly 7, 8 may be monitored constantly, for example. Thus, in the example of FIG. 3 the neutralisation current of activated negative electrode assembly 8 is monitored in working phase 25. If irregularities or predetermined events occur within this neutralisation current, controller 18 can switch from the current operating mode to another operating mode. Advantageously, controller 18 switches from working phase 25 back to learning phase 24, in which both high voltage sources 12, 15 are active, and advantageously apply DC voltage 26, 27 to both active electrode assemblies 7, 8.

Additionally or alternatively thereto, a degree of electrode abrasion and/or a degree of electrode contamination may also be monitored by measuring a quiescent current of the respective active electrode assembly 7, 8 and/or the sensor electrode assembly 9.

The quiescent current is expediently monitored during a diagnostic phase, which is active or switched on for example whenever material web 2 is started up, for example after the material web has been changed. When material web 2 is started up or at a standstill, there is little or no build-up of static charge, so that particularly no ions flow from one of the ionisation electrodes 7, 8 to the material web. The same is also true for passive sensor electrode assembly 9. On the other hand, ions flow through the air between negative electrode assembly 8 and positive electrode assembly 7, and between sensor electrode assembly 9 and at least one of the ionisation electrode assemblies 7, 8. These quiescent currents vary significantly according to the degree of contamination, and also correlate with the abrasion of electrodes 10, 13, 16, and with the erosion of electrode tips 10, 13, 16.

Figure 4:
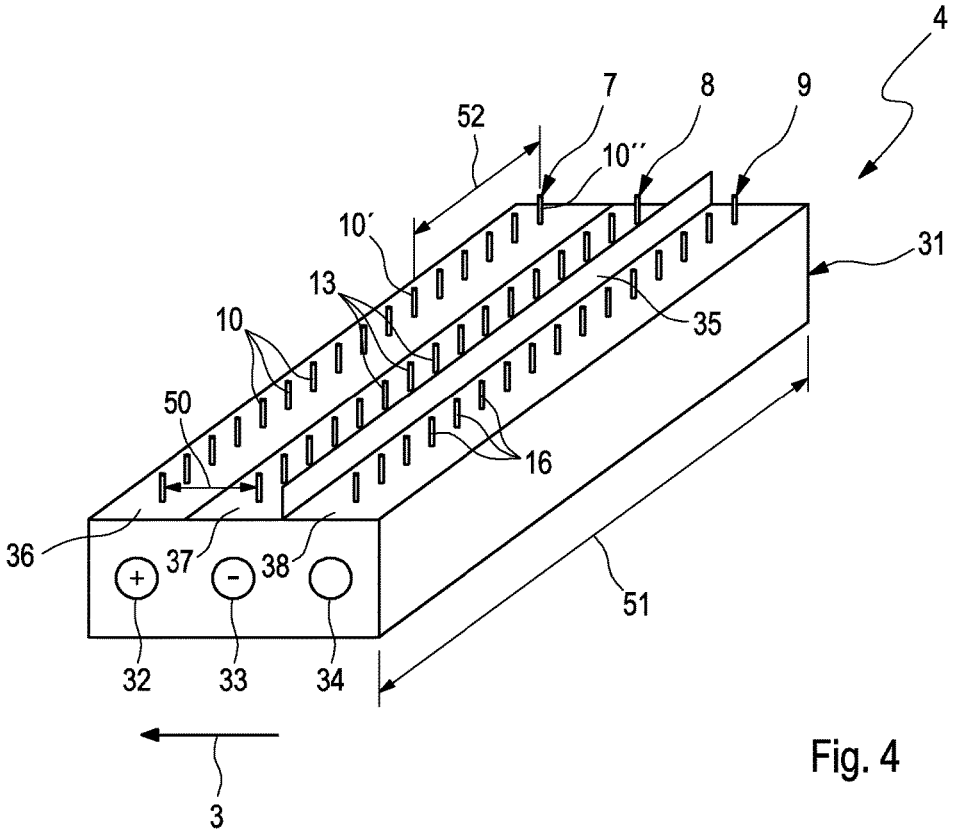
Figure 6:
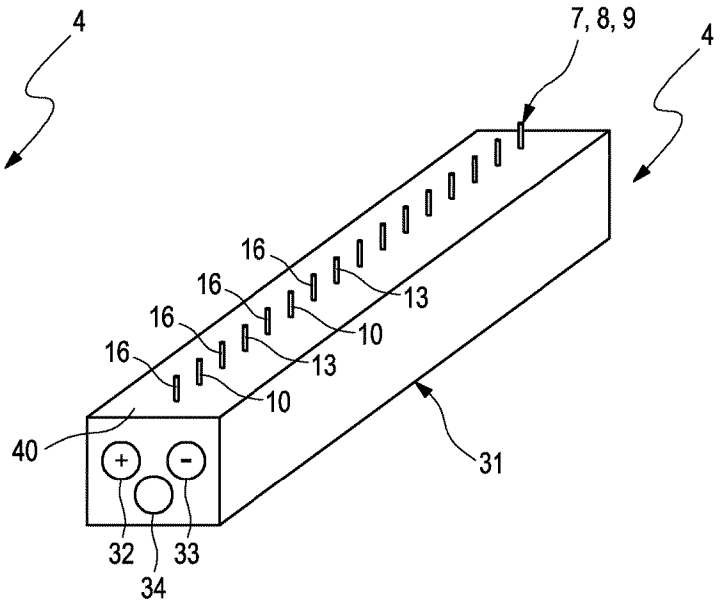
Figure 5:
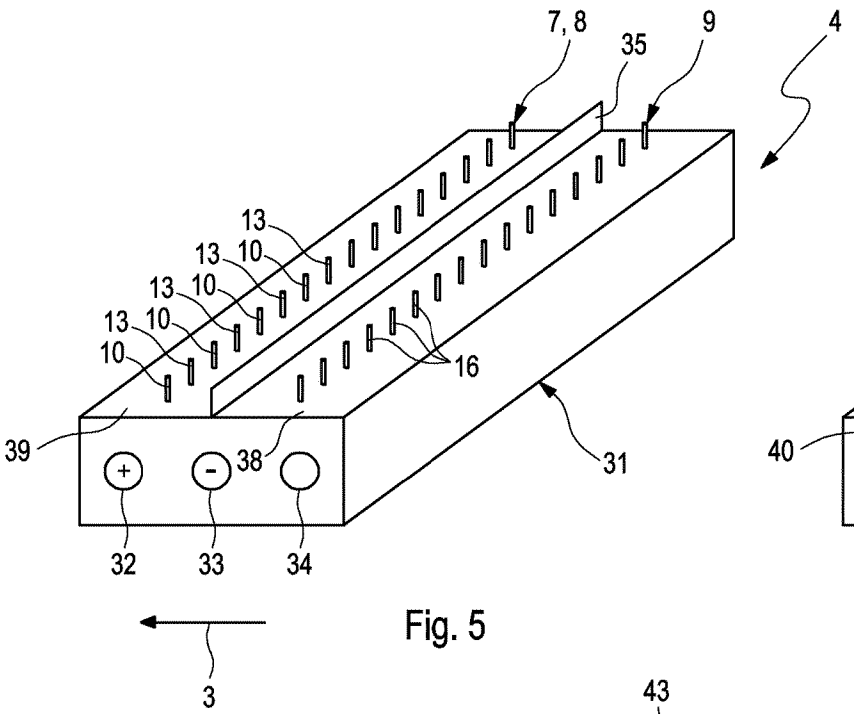

As shown in FIGS. 4 to 6, positive electrode assembly 7, negative electrode assembly 8 and sensor electrode assembly 9 may be arranged in or on a common bar-shaped electrode carrier 31. Electrode carrier 31 then comprises a positive terminal 32 for connecting positive electrode assembly 7 to positive high voltage source 12, a negative terminal 33 for connecting negative electrode assembly 8 to negative high voltage source 15, and a sensor terminal 34 for connecting sensor electrode assembly 9 to sensor system 20. In the embodiments of FIGS. 4 and 5, electrode carrier 31 may include a partition wall 35, which may particularly be configured to be electrically insulating and to extend between the two active electrode assemblies 7, 8 on the one side and sensor electrode assembly 9 on the other. In this way a short circuit through the air between the two active electrode assemblies 7, 8 and the passively functioning sensor electrode assembly 9 may be avoided. To improve this effect, partition wall 35 may be designed so that it extends beyond electrodes 10, 13, 16 and the tips thereof in the direction of material web 2.

In the embodiment shown in FIG. 4, the individual positive electrodes 10 are arranged in a straight row of positive electrodes 36. Negative electrodes 13 are arranged in a straight row of negative electrodes 37, and sensor electrodes 16 are arranged in a straight row of sensor electrodes 38. Thus, FIG. 4 shows an embodiment with three separate rows of electrodes 36, 37, 38, which are positioned one behind the other relative to the direction of movement 3 of material web 2 when antistatic device 4 is installed, and rows 36, 37, 38 extend transversely to direction of movement 3.

FIG. 5 shows a particularly advantageous embodiment in which positive electrodes 10 and negative electrodes 13 are arranged side by side together in a shared straight row of electrodes 39, in such a way that they alternate with each other. In the embodiment shown in FIG. 5, therefore, only two rows of electrodes 38, 39 are discernible.

In the embodiment shown in FIG. 6, a single row of electrodes 40 is provided, in which positive electrodes 10, negative electrodes 13 and sensor electrodes 16 are arranged side by side in alternating sequence. The order in which the various electrodes 10, 13, 16 alternate in said row of electrodes 40 is indicated in FIG. 6 for exemplary purposes only, so any other sequence or order may also be implemented.

Since the antistatic device 4 shown here only works with one active electrode assembly 7 or 8 when operating, that is to say during working phase 25, it is not necessary to maintain an especially large distance between electrode assemblies 7, 8, even relative to direction of movement 3 of material web 2. For example, as shown in FIG. 4, the two active electrode assemblies 7, 8 are positioned at a distance 50 from one another in the direction of movement 3 of material web 2 that is smaller than an extension 51 of antistatic device 4 and electrode carrier 31 transversely to material web 2, or smaller than a distance 52 between a first electrode 10' and a last electrode 10" of an electrode group comprising at least five electrodes 10 arranged one after the other or side by side within one of the electrode assemblies 7, 8. In the example of FIG. 4, said electrode group contains five individual electrodes 10. Of course, the electrode group may also comprise more than five electrodes 10, ten for example. Such a compact construction may also be realised if active electrode assemblies 7, 8 are arranged in separate electrode carriers, as long as the small separation distances in the direction of motion 3 of material web 2 described above are observed.

Figure 7:
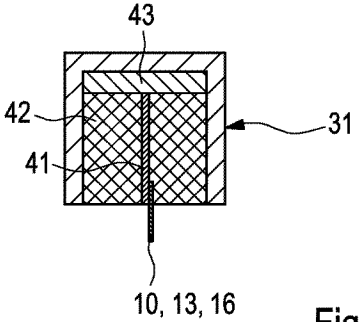

FIG. 7 shows a cross section through am electrode carrier 31 with a U-shaped profile, which contains only one row of electrodes in the example. This may be positive electrode row 36 or negative electrode row 37, or also sensor electrode row 38, or the shared electrode row 39, or even shared electrode row 40. The respective electrode 10, 13, 16 is mounted on a substrate 41, which is embedded in an electrically insulating material 42. Electrode carrier 31 also includes a high voltage conductor 43 that is electrically connected to the respective terminal 32, 33 or 34. High voltage conductor 43 may be made from a carbon fibre composite body and in this case may serve to stiffen electrode carrier 31. In the example, the carbon fibre composite body is in the form of a strip and flat, and has a rectangular profile.

Figure 8:
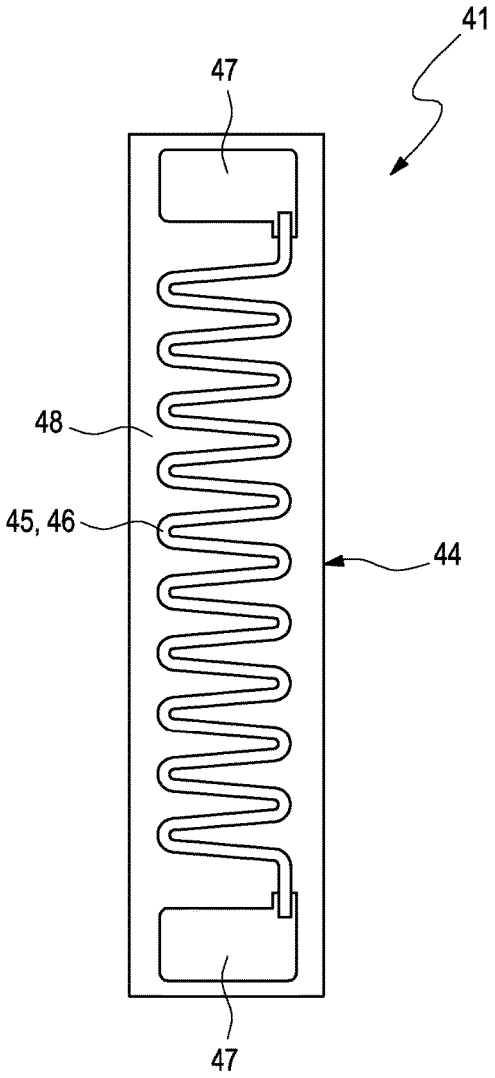

As shown in FIG. 8, substrate 41, on which electrode 10, 13, 16—not shown in FIG. 8—can be mounted, comprises a carrier material 44 on which a resistor track 45 made from a resistor paste 46 is imprinted. In addition, two contact zones 47 are imprinted on substrate 44 in the region of the ends of resistor track 45, such that the ends of resistor track 45 are in electrical contact with the two contact zones 47. Substrate 44 is advantageously a plastic material. For example, said plastic material may be FR4, which is used for example for manufacturing printed circuit boards. Alternatively, the plastic material may be polyester or PEEK or polyimide. Resistive paste 46 is a polymer paste. Examples of substances that may be considered for use as polymer paste include an epoxy resin varnishing system, wherein electrically conductive particles and electrically non-conductive particles are embedded in the epoxy resin. The ratio of the electrically conductive particles to electrically non-conductive particles, and the density of the particles within the epoxy resin determine the electrical resistance of the resistive track 45 that is produced using the polymer paste. Electrically conductive particles are for example carbon black or graphite. Electrically non-conductive particles are for example titanium oxide (TiO) and aluminium oxide ($Al_2O_3$). Substrate 41 may be manufactured with resistance values ranging from 100 kΩ to 100 GΩ. Substrate 41 may be used in voltage ranges from 1 KV up to 150 KV. Substrate 41 has a power consumption not exceeding 1 W. Depending on the size of substrate 1, in principle the power consumption may also be greater than 1 W.

Since a plastic is used as carrier material 44, it is also possible to implement relatively thin support materials 44, having a thickness less than 1 mm or less than 1.0 mm. In this case, it is also possible to create a flexible carrier material 44 depending on the plastic material used. In particular, substrate 41 may be constructed as a carrier foil. Said carrier will also be designated with reference sign 41 in the following.

Contact zones 47 can be used to attach said electrode 10, 13, 16 to one side of carrier foil 41, and an electrical connection to the other side. The respective terminal and the respective electrode 10, 13, 16 may be soldered to the respective contact zone 47, for example. It is also possible to crimp the terminals or electrodes 10, 13, 16 with contact zones 47. Alternatively, electrical contacts may also be produced by applying a coating or adhesive layer using an electrically conductive adhesive or an electrically conductive varnish. A plug connection or clamping connection is also conceivable. Foil carrier 41 may also be provided with a protective layer 48 made from a plastic, which is designed to be electrically insulating and is applied to carrier foil 41 in such manner as to cover at least the resistive paste 46 or resistor track 45. More particularly, the entire carrier material 44 may be coated with said electrically insulating protective layer 48, preferably leaving recesses for electrical contact zones 47.

In order to manufacture the carrier foil 41 presented here, the electrical contact zones 47 may first be imprinted on carrier material 44. Then, contact zones 47 may be burned in. Contact zones 47, may be burned in in a temperature range from about 150° C. to 220° C. inclusive. Electrical contact zones 47 may be made from conductive silver for example, which may preferably be prepared on a polymer epoxy resin. After electrical contact zones 47 are burned in, the respective resistor track 45 can be imprinted on carrier material 44. After resistor track 45 has been imprinted, said resistor track 45 is also burned in. The burning in process for resistor track 45 may be carried out in a temperature range from about 150° C. to about 240° C. inclusive. After the respective resistor track 45 has been burned in, an injection moulding process may also be carried out, by means of which the insulation layer 48 is applied. Insulation layer 48 covers at least resistor track 45. Depending on whether electrical terminals and electrodes 10, 13, 16 have already been attached to contact zones 47, insulation layer 48 may also cover contact zones 47. The injection moulding process for applying insulating layer 48 is preferably designed as a low-temperature spraying process, which is carried out at a temperature below 200° C. Contact zone 47 and/or resistance track 45 is/are expediently applied in a screen printing process. The use of a polymer paste as a resistance paste 46 makes it possible to burn in resistor track 45 at relatively low temperatures, so that a plastic material may be used for carrier material 44. In this way, carrier foil 41 is extremely inexpensive. The manufacturing process is also relatively inexpensive, since only relatively low firing temperatures have to be implemented, so the energy requirements for obtaining the firing temperatures and carrying out the burning in processes are comparatively low. An embodiment of the process in which a plurality of carrier foils 41 is produced on a sheet of carrier material 44 at the same time, and are then separated by cutting or punching is particularly convenient. In this way, the time for producing single carrier foils 41 can be significantly reduced by printing a plurality of contact zones 47 and/or a plurality of resistor tracks 45 at the same time.

Figure 9:
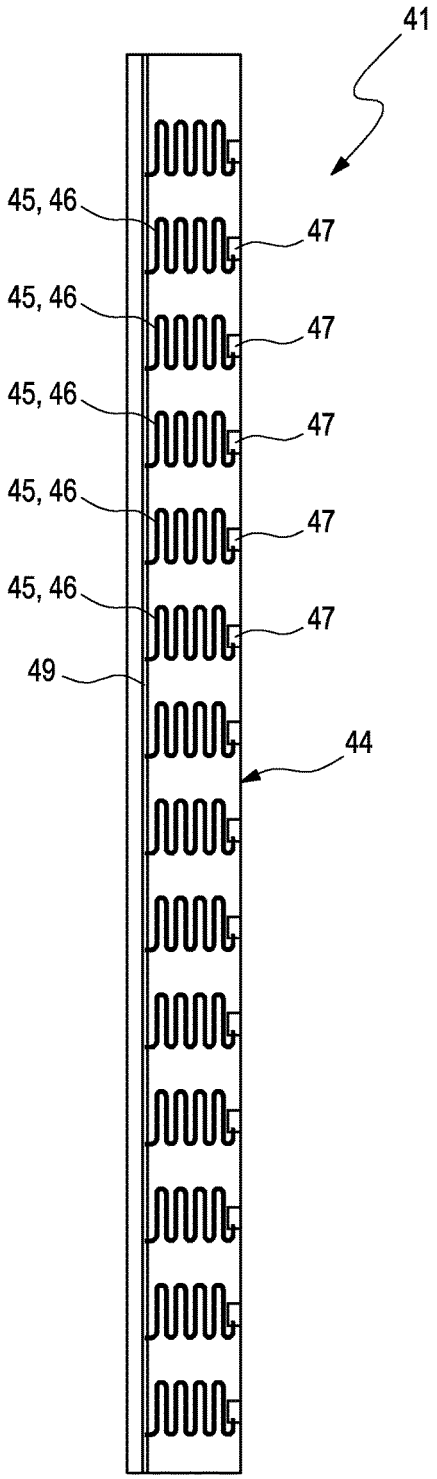

The carrier foil 41 shown in FIG. 8 is suitable for positioning a single electrode 10, 13, 16. Of course, as shown in FIG. 9 for example, in other embodiments a plurality of electrodes 10, 13, 16 may be arranged on such a carrier foil 41, in which case a corresponding number of series resistors 11, 14, 17 may be imprinted on carrier foil 41 in the form of resistance paths 45. It is also possible to provide a common carrier foil 41 bearing all series resistors 11 in the form of resistance paths 45 for all positive electrodes 10. The same applies for a shared carrier foil 41 for all negative electrodes 13 with the corresponding series resistors 14. Again, this also applies for a shared carrier sheet 41 for all sensor electrodes 16 and the associated series resistors 17 in the form of resistive tracks 45. In principle, any permutations of the above arrangements are also conceivable.

As shown in FIG. 9, in another embodiment of carrier foil 41 it may be provided to imprint a plurality of resistor tracks 45 made from resistive paste 46 on carrier material 44. Further, a corresponding number of contact zones 47 may also be imprinted, for contacting the electrodes 10, 13 or 16 for example. If electrodes 10, 13, 16 are assigned to the same electrode assembly 7, 8, 9, all the resistive tracks 45 may be electrically connected to each other via a common contact strip 49, wherein the contact strip 49 itself is imprinted in correspondence with contact zones 47. In this context, an embodiment in which carrier foil 41 is produced from a flexible material is particularly advantageous. It is also advantageous if carrier foil 41 is produced as a continuous strip together with resistive tracks 45, contact zones 47 and contact strip 49. The carrier foil 41 may then be customised for a given application by cutting the required number of electrodes to size.

In another advantageous embodiment, it may be provided for the carrier foil 41 to be usable on both sides. For example, positive electrode assembly 7 may be created on the front of carrier foil 41, facing the viewer in FIG. 9, by applying series resistors 11 of positive electrodes 10 to the front of carrier foil 41 in the form of resistive tracks 45. Resistive tracks 45 may then be applied to the rear of carrier foil 41, facing away from the viewer in FIG. 9, to form series resistors 14 of negative electrode assembly 8. In this case, carrier foil 41 can be printed conveniently on both sides in such manner that that the positive electrodes 10 and negative electrodes 11 are printed in alternating sequence in the longitudinal direction of carrier foil 41. Further, printed conductor strips 49 may be positioned such that a short circuit through the support material 44 can be avoided.

The invention claimed is:

1. An antistatic device for reducing electrostatic charges on moving material webs, comprising:

an active positive electrode assembly including a plurality of active, needle-shaped individual positive electrodes electrically connected to a positive high voltage source during operation of the antistatic device;

an active negative electrode assembly including a plurality of active, needle-shaped individual negative electrodes electrically connected to a negative high voltage source during operation of the antistatic device;

a sensor system for detecting a polarity of a neutralizing current between the material web and the antistatic device during operation of the antistatic device;

a controller for controlling the high voltage sources; and a sensor electrode assembly including a plurality of needle-shaped individual sensor electrodes and is electrically connected to a grounding element during operation of the antistatic device;

wherein the controller is coupled to the sensor system and is at least one of programmed and configured to one of activate and leave activated the high voltage source required in each case and one of and deactivate and leave deactivated the high voltage source not required in each case in response to the detected polarity of the neutralizing current;

wherein the controller actuates the respectively activated high voltage source, the high voltage source configured to deliver one of a non-pulsed positive and negative DC voltage;

wherein the sensor system is at least one of programmed and configured to monitor the current flowing out from the sensor electrode assembly in order to detect the polarity of the neutralization current;

wherein the controller is at least one of programmed and configured to determine the polarity of the neutralization current of the sensor electrode assembly during the learning phase and switch to the working phase in response to the detected polarity, and in said working phase the controller actuates the high voltage source of the required active electrode assembly for generating the non-pulsed DC voltage; and wherein the controller is at least one of configured and programmed to one of:

during the learning phase, actuate both high voltage sources for generating a pulsed DC voltage at the respective active electrode assembly, and in the working phase deactivate the high voltage source of the active electrode assembly that is not needed, and switch from pulsed DC voltage to non-pulsed DC voltage for the required active electrode assembly, and keep both high voltage sources deactivated during the learning phase and in the working phase activate the high voltage source of the required electrode assembly.

2. The antistatic device according to claim 1, wherein the controller is at least one of configured and programmed to switch between at least a learning phase, during which the positive high voltage source and the negative high voltage source are activated, and a working phase, in which only one of the high voltage sources is active, and wherein the sensor system is at least one of configured and programmed to monitor the currents flowing out of the respective high voltage source in order to detect the polarity of the neutralization current.

3. The antistatic device according to claim 1, wherein the sensor system is configured to measure the neutralising current from the respectively activated active electrode assembly, and the controller is configured for controlling the high voltage sources, and wherein the controller is coupled to the sensor system and is at least one of programmed and configured to switch automatically between two operating modes of the antistatic device depending on the measured neutralisation current.

4. The antistatic device according to claim 1, wherein the sensor system is configured to measure a quiescent current of at least one of the two active electrode assemblies and of the sensor electrode assembly, the controller is configured for controlling the high voltage sources, wherein the controller is coupled to the sensor system and is at least one of programmed and configured to evaluate the measured quiescent current for detecting at least one of electrode abrasion and contamination, and wherein the controller performs the measurement and evaluation of the quiescent current during a diagnostic phase which is carried out during start-up of the material web.

5. The antistatic device according to claim 1, wherein the active positive and negative electrode assemblies are arranged one of in and on a common electrode carrier.

6. The antistatic device according to claim 1, wherein the sensor electrode assembly is arranged one of in and on the common electrode carrier.

7. The antistatic device according to claim 5, wherein the common electrode carrier includes terminals for the high voltage sources and the sensor system.

8. The antistatic device according to claim 5, wherein the common electrode carrier includes a partition wall located between the active electrode assemblies and the sensor electrode assembly, wherein the partition wall is designed to be at least one of electrically insulating and the partition wall projects beyond the electrodes in the direction of material web.

9. The antistatic device according to claim 7, wherein the common electrode carrier includes at least one high voltage conductor electrically connected to at least one respective terminal.

10. The antistatic device according to claim 1, wherein at least one of:

the sensor electrodes are arranged side by side in a straight sensor electrode row, the positive electrodes are arranged side by side in a straight positive electrode row, the negative electrodes are arranged side by side in a straight negative electrode row, the positive electrodes and the negative electrodes are arranged side by side in a common straight electrode row in an alternating sequence, and the sensor electrodes, the positive electrodes, and the negative electrodes are arranged side by side in a common straight electrode row in an alternating sequence.

11. The antistatic device according to claim 1, wherein at least one of:

at least one positive electrode is disposed on a carrier foil on which at least one of a series resistor of said positive electrodes are imprinted, at least one negative electrode is disposed on the carrier foil on which at least one of a series resistor of the negative electrodes are imprinted, at least on of a series resistor of the sensor electrodes are imprinted, the positive electrodes and the negative electrodes are disposed on a common carrier foil, on which the series resistors of the positive electrodes and the negative electrodes are imprinted, and the sensor electrodes, the positive electrodes and the negative electrodes are disposed on the common carrier foil, on which the series resistors of the sensor electrodes, the series resistors of the positive electrodes, and the series resistors of the negative electrodes are imprinted.

12. The antistatic device according to claim 11, wherein the carrier foil is at least one of:

prepared together with the electrodes and the series resistors in a continuous strip material, furnished with series resistors on both sides thereof, and consists of a flexible material.

13. A method for operating an antistatic device for reducing electrostatic charge on a moving web of material, comprising: activing a positive electrode assembly and a negative electrode assembly, in which a polarity of the moving material web is determined via a sensor system, and wherein the positive and negative electrode assembly required in each case to reduce the electrostatic charge of the moving material web depending on the determined polarity is one of activated and left in the activated state, while the respective positive and negative electrode assembly that is not required is one of deactivated and left in the deactivated state, wherein a respectively activated positive and negative high voltage source is actuated such that the positive and negative high voltage source delivers one of a non-pulsed positive and negative DC voltage, respectively;

wherein the polarity of the material web is determined during a learning phase and the required positive and negative electrode assembly for generating the non-pulsed DC voltage is actuated in a working phase;

wherein the two active positive and negative electrode assemblies are operated with a pulsed DC voltage during the learning phase such that positive current pulses of the positive electrode assembly alternate with negative current pulses of the negative electrode assembly, and wherein during the working phase one active electrode assembly is deactivated while the other active electrode assembly is activated, the activated electrode assembly operating with non-pulsed DC voltage.

14. The method according to claim 13, wherein a neutralization current of the respectively activated active positive and negative electrode assembly is measured during the working phase and the antistatic device is switched automatically between at least two operating modes in response to the measured neutralization current, and wherein a quiescent current of at least one of the two active positive and negative electrode assemblies and a sensor electrode assembly is measured, wherein the measured quiescent current is evaluated for detecting at least one of electrode abrasion and electrode contamination, and wherein the measurement and evaluation of the quiescent current is performed during a diagnostic phase which is performed during at least on of startup and standstill of the material web.

15. The method according to claim 13, wherein the two active electrode assemblies initially operate with a predetermined initial pulse width ratio of positive current pulses to negative current pulses during the learning phase, and during the learning phase, after the polarity of the material web has been determined, the two active electrode assemblies operate with at least one transition pulse width ratio of positive current pulses to negative current pulses, the at least one transition pulse width ratio is compared to the initial pulse-width ratio, wherein the current pulses required for neutralizing the material web for the at least one transition pulse width ratio are lengthened, whilst the current pulses that are not needed are shortened correspondingly.

* * * * *